US008206461B1

(12) United States Patent
Herga

(10) Patent No.: US 8,206,461 B1
(45) Date of Patent: Jun. 26, 2012

(54) PROCESS AND DEVICE FOR TREATING LEATHER

(75) Inventor: Davorin Herga, Gorišnica (SI)

(73) Assignee: BOXMARK LEATHER proizvodnja in trgovina d.o.o., Kidričevo (SI)

( * ) Notice: Subject to any disclaimer, the term of this patent is extended or adjusted under 35 U.S.C. 154(b) by 0 days.

(21) Appl. No.: 13/215,253

(22) Filed: Aug. 23, 2011

(30) Foreign Application Priority Data

Jan. 28, 2011 (EP) ..... 11000700

(51) Int. Cl.
*C14C 1/00* (2006.01)

(52) U.S. Cl. ..... 8/94.15; 8/94.19 R; 8/94.2; 8/94.21

(58) Field of Classification Search ..... 8/94.15, 8/94.19 R, 94.2, 94.21
See application file for complete search history.

(56) References Cited

FOREIGN PATENT DOCUMENTS

| | | |
|---|---|---|
| DD | 219 506 | 3/1985 |
| EP | 0 990 707 A2 | 4/2000 |
| WO | WO 01/32937 | 5/2001 |
| WO | WO 01/32937 A1 * | 5/2001 |

* cited by examiner

*Primary Examiner* — Eisa Elhilo
(74) *Attorney, Agent, or Firm* — Robert Platt Bell

(57) ABSTRACT

Leather in form of hides or articles of leather or other articles comprised of similarly behaving material is introduced (for purposes of this application all of these articles of leather jointly referred to as "hides") into rotating drum or stirring vessel or other form of similar device where it undergoes spraying with chemicals and drying to desired humidity to be followed by drying and another treatment of milling in rotating drum.

19 Claims, 2 Drawing Sheets

PROCESS AND DEVICE FOR TREATING LEATHER

CROSS-REFERENCE TO RELATED APPLICATIONS

The present application claims priority from European Patent Application Serial Number EP11000700.2, filed on Jan. 28, 2011 and incorporated herein by reference.

FIELD OF THE INVENTION

The problem which is related to this invention is in shortening of time of exposure of hides subject to leather treatment to treating chemicals and shortening necessary drying time.

BACKGROUND OF THE INVENTION

There are several processes known in the state of the art for tanning or treatment of leather. One which is relevant is putting several hides in a rotating drum filled with tanning bath and subjecting said hides to rotation. During rotation, the hides are soaked with tanning ingredients. After soaking, there is drying, using different processes, known in the art and not subject of the present invention hence unrelated to it.

European Patent EP 0 990 707 discloses a method for controlling the dosage cycle of chemicals, air and water in a fulling, tanning and dyeing drum, whereby, in a normal operating phase, the drum turns around its axis and air is circulated inside this drum by means of a blower, after being heated by the heating unit controlled by a thermostat connected to a relative humidity detector capable of signaling, should the humidity of the air inside the drum be less than a set rate. Further, this patent discloses a method whereby the water is sprayed in a mist by at least one nozzle.

SUMMARY OF THE INVENTION

The above referenced technical problem is solved with process and device for treating leather.

Leather in form of hides or articles of leather or other articles comprised of similarly behaving material is introduced (for purposes of this application all of these articles of leather jointly referred to as "hides") into a rotating drum or stirring vessel or other form of similar device where it undergoes spraying with chemicals and drying to desired humidity to be followed by drying and another treatment of milling in rotating drum.

Below, the essence of the present invention is described with help of the attached drawing, this drawing forming part of this patent application.

DETAILED DESCRIPTION OF THE INVENTION

For purposes of this application hide or plurality thereof (2) can also be other articles in need for surface treatment by exposure to spray droplets.

Figure 1:
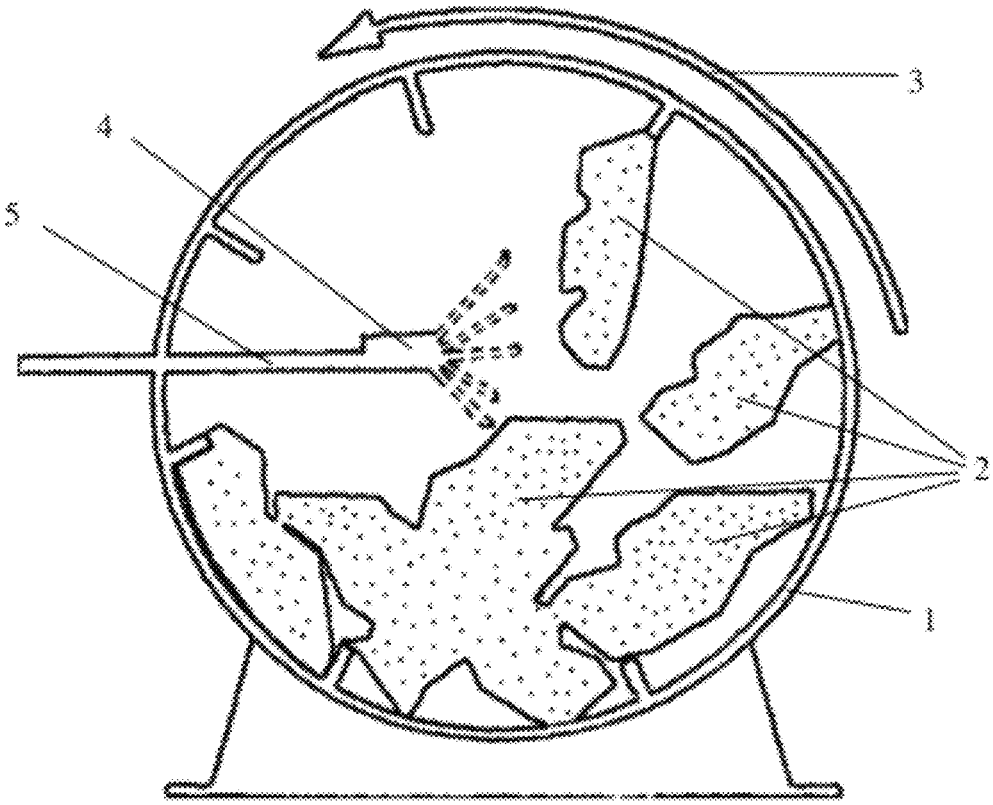
FIG. 1 is a diagram illustrating a drum (1) filled with a hide or plurality thereof (2), direction of turning of said drum (3), nozzle for spraying chemicals (4), and delivery tube for said chemicals (5).
Figure 2:
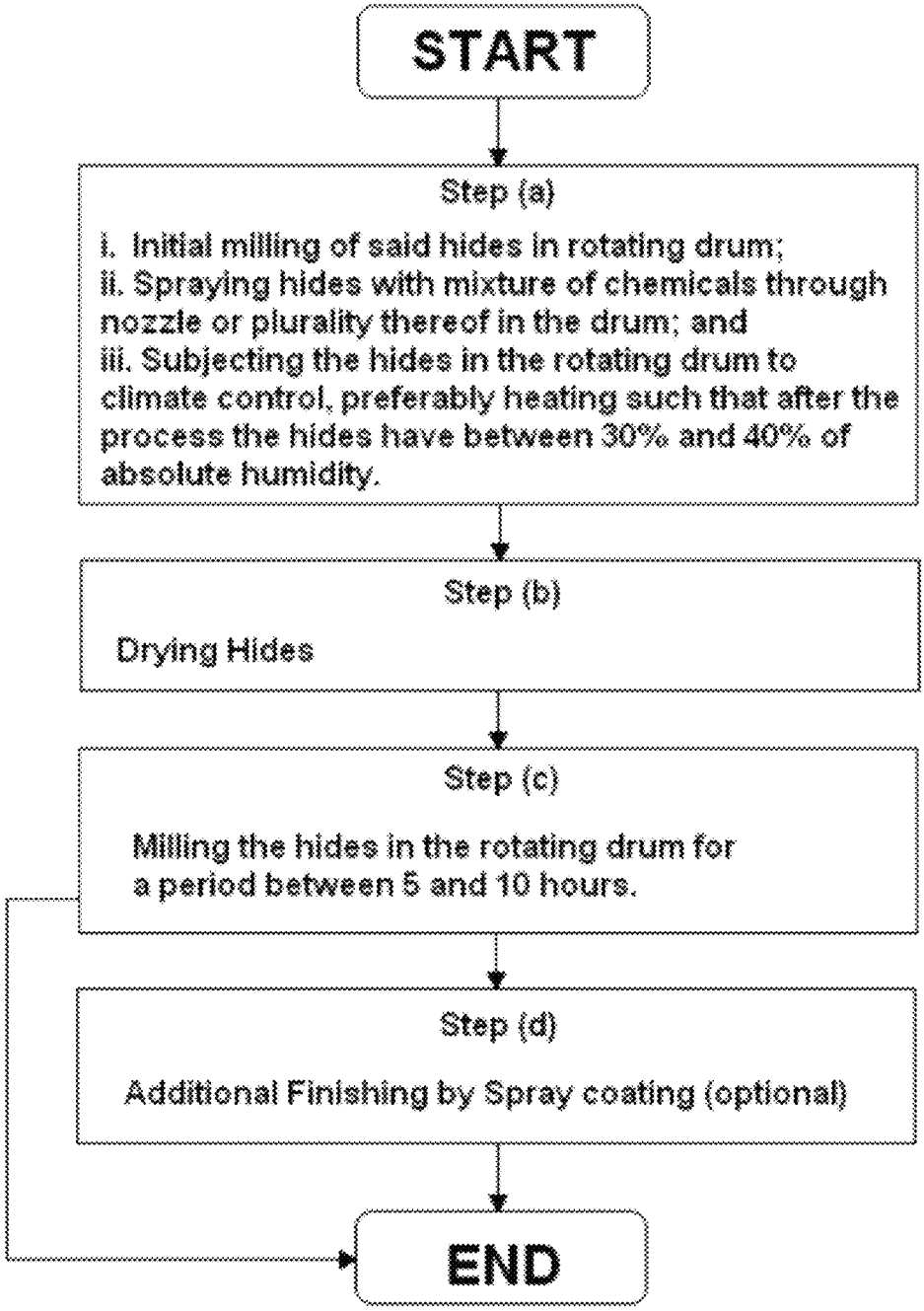
FIG. 2 is a flow chart illustrating the steps in the process of the present invention.

Referring to FIGS. 1 and 2, in essence the process is performed in a rotating drum (1) in three steps, said drum rotating in either direction. For purposes of this application said drum (1) can also be in other form such as stirring vessel, or ball, or other application meant of ensuring that the surface of hide or plurality thereof (2). Said drum (1) is equipped with temperature control system, preferably heating system, and with climate control system, preferably with device able to regulated humidity, more preferably by device capable by spraying water into said drum (1).

The hide or plurality thereof (2) is inserted in their finished or semi-finished form, for purpose of embodiment as finished leather. The hide or plurality thereof (2) is treated with a special mixture of different components.

In preferred embodiment 5 to 100 finished leather hides are inserted into said drum (1).

In preferred embodiment said drum (1) measures 2 to 4 meters in diameter, rotating at 10 to 30 revolutions per minute. Load factor may be assessed from these results given average size of said hide (2) being of large mammal (such as a cow).

(a) First step

The first step is comprised of wetting said hides (2) with chemicals and exposing them to suitable heat treatment.

The first part of first step to be treated during period of 5 to 30 minutes by rotating of said hides (2) in said drum (1).

After this period, spraying of said mixture is commenced through nozzle (4) with the mixture of chemicals, the composition of this mixture not being part of this patent application, said mixture introduced to the nozzle (4) through delivery tube (5). It should be noted that several nozzles (4) may be used, placed in different positions throughout said drum (1).

Said spraying lasts between 5 and 120 minutes depending on the concentration of the mixture and the number of said hides (2) in said drum (1).

Following spraying, said hides (2) remain in said drum (1) being subject to further milling for a period necessary for said hides (2) to have 30% to 40% absolute humidity (as defined by standards, for example and in particular DIN EN ISO 4684). In preferred embodiment, this period lasts between 1 and 6 hours and hides (2) are subject to climate control, preferably heating.

After processing, the absolute humidity of said hides (2) is measured, and if the results are below 30% additional water is sprayed while drum (1) is rotated.

(b) Second step

The second step of the process is the drying of said (slightly wet) hides at elevated temperature between 40 and 60° C. until a residual absolute humidity between 5 and 10% within the hides is reached.

This step is performed outside of said drum (1) on racks or using other means known in state of the art.

(c) Third step

The third step is milling said hides (2) in said drum (1) again at dry conditions and temperatures between 30 and 50° C. for 5 to 10 hours.

(d) Optional fourth step

An optional fourth step is giving the treated leather an additional finishing by spray coating.

While the preferred embodiment and various alternative embodiments of the invention have been disclosed and described in detail herein, it may be apparent to those skilled in the art that various changes in form and detail may be made therein without departing from the spirit and scope thereof.

I claim:

1. Process for treating leather, comprised of milling of hides in a rotating drum characterized in that it comprises the following steps:

a. Said milling of hides (2) in a rotating drum (1) is further comprised of following sub-processes:

i. initial milling of said hides (2) in said rotating drum (1);

ii. spraying of said hides (2) with mixture of chemicals through nozzle (4) or plurality thereof in said drum (1);

iii. subjecting of said hides (2) in rotating drum (1) to climate control, heating after the process the hides (2) have between 30% and 40% of absolute humidity;

b. Drying of hides (2);

c. Milling of said hides (2) in said rotating drum (1) for period between 5 and 10 hours.

2. Process according to claim 1, characterized in that initial milling of said hides (2) in said drum (1) lasts between 5 and 30 minutes.

3. Process according to claim 1, characterized in that spraying of said hides (2) in said drum (1) by said chemicals lasts between 5 and 120 minutes.

4. Process according to claim 2, characterized in that spraying of said hides (2) in said drum (1) by said chemicals lasts between 5 and 120 minutes.

5. Process according to claim 1, characterized in that milling of said hides (2) in said drum (1) until they reach desired absolute humidity between 30 and 40% lasts from 1 to 6 hours.

6. Process according to claim 2, characterized in that milling of said hides (2) in said drum (1) until they reach desired absolute humidity between 30 and 40% lasts from 1 to 6 hours.

7. Process according to claim 3, characterized in that milling of said hides (2) in said drum (1) until they reach desired absolute humidity between 30 and 40% lasts from 1 to 6 hours.

8. Process according to claim 5, characterized in that if after treatment the humidity of said hides (2) falls below 30% said hides (2) are sprayed with water in said rotating drum (1) until their absolute humidity is measured between 30 and 40%.

9. Process according to claim 6, characterized in that if after treatment the humidity of said hides (2) falls below 30% said hides (2) are sprayed with water in said rotating drum (1) until their absolute humidity is measured between 30 and 40%.

10. Process according to claim 7, characterized in that if after treatment the humidity of said hides (2) falls below 30% said hides (2) are sprayed with water in said rotating drum (1) until their absolute humidity is measured between 30 and 40%.

11. Process according to claim 8, characterized in that said hides (2) are dried at elevated temperature between 40 and 60° C. until a residual absolute humidity between 5 and 10% within the hides is reached.

12. Process according to claim 9, characterized in that said hides (2) are dried at elevated temperature between 40 and 60° C. until a residual absolute humidity between 5 and 10% within the hides is reached.

13. Process according to claim 10, characterized in that said hides (2) are dried at elevated temperature between 40 and 60° C. until a residual absolute humidity between 5 and 10% within the hides is reached.

14. Process according to claim 11, characterized in that final milling of said hides (2) in said drum (1) at dry conditions occurs at temperatures between 30 and 50° C.

15. Process according to claim 12, characterized in that final milling of said hides (2) in said drum (1) at dry conditions occurs at temperatures between 30 and 50° C.

16. Process according to claim 13, characterized in that final milling of said hides (2) in said drum (1) at dry conditions occurs at temperatures between 30 and 50° C.

17. Process according to claim 14, characterized in that the treated leather is given an additional finishing by spray coating.

18. Process according to claim 15, characterized in that the treated leather is given an additional finishing by spray coating.

19. Process according to claim 16, characterized in that the treated leather is given an additional finishing by spray coating.

* * * * *